US012668414B2

(12) United States Patent
Lee

(10) Patent No.: US 12,668,414 B2
(45) Date of Patent: Jun. 30, 2026

(54) PACKAGE FOR SILICON PHOTONICS DEVICE AND IMPLEMENTATION METHOD THEREOF

(71) Applicant: ELECTRONICS AND TELECOMMUNICATIONS RESEARCH INSTITUTE, Daejeon (KR)

(72) Inventor: Jyung Chan Lee, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 677 days.

(21) Appl. No.: 18/106,646

(22) Filed: Feb. 7, 2023

(65) Prior Publication Data

US 2023/0278777 A1 Sep. 7, 2023

(30) Foreign Application Priority Data

Mar. 3, 2022 (KR) ..... 10-2022-0027238

(51) Int. Cl.
*G02B 6/42* (2006.01)
*B65D 81/18* (2006.01)
(Continued)

(52) U.S. Cl.
CPC ..... *B65D 85/62* (2013.01); *B65D 81/18* (2013.01)

(58) Field of Classification Search
CPC ..... G02B 6/4272; G02B 6/428; G02B 6/423; G02B 6/4269; G02B 6/00; G02B 6/42;
(Continued)

(56) References Cited

U.S. PATENT DOCUMENTS 9,250,401 B2 2/2016 Lim et al.
10,338,326 B2 7/2019 Kim et al.
(Continued)

FOREIGN PATENT DOCUMENTS

JP 2003-121707 A 4/2003
JP 2013-190821 A 9/2013
(Continued)

*Primary Examiner* — Antonio B Crite
(74) *Attorney, Agent, or Firm* — LRK PATENT LAW FIRM

(57) ABSTRACT

A package for a silicon photonics device and an implementation method thereof are disclosed. The package for a silicon photonics device according to one embodiment includes a step difference control part having an upper surface, where a silicon photonics device platform having a silicon photonics device mounted thereon is mounted, and configured to control a step difference generated between the silicon photonics device platform and one or more functional electronic devices mounted on an upper surface of a board and a body part configured to transfer heat transferred through the step difference control part and heat transferred through a lower surface of the board to the outside by mounting the step difference control part on at least a partial region of an upper surface thereof and bringing the lower surface of the board into close contact with at least a part of the remaining region except for the partial region.

20 Claims, 13 Drawing Sheets

(51) Int. Cl.
*B65D 85/62* (2006.01)
*H10W 40/25* (2026.01)
*H10W 70/68* (2026.01)

(58) Field of Classification Search
CPC ..... G02B 6/24; B65B 85/62; B65B 81/18; H10W 70/68; H10W 70/00
See application file for complete search history.

(56) References Cited

U.S. PATENT DOCUMENTS

| | | | | |
|---|---|---|---|---|
| 2004/0252953 | A1 | 12/2004 | Crane, Jr. et al. | |
| 2022/0397726 | A1* | 12/2022 | Karhade ..... | G02B 6/4202 |

FOREIGN PATENT DOCUMENTS

| | | | |
|---|---|---|---|
| JP | 2016-167005 | A | 9/2016 |
| KR | 10-1266561 | B1 | 5/2013 |
| KR | 10-2017-0007935 | A | 1/2017 |
| KR | 10-2031573 | B1 | 10/2019 |

* cited by examiner (a)

(b)

(a)

(b)

(a)

(b)

PACKAGE FOR SILICON PHOTONICS DEVICE AND IMPLEMENTATION METHOD THEREOF

CROSS-REFERENCE TO RELATED APPLICATION

This application claims priority to and the benefit of Korean Patent Application No. 10-2022-0027238, filed on Mar. 3, 2022, the disclosure of which is incorporated herein by reference in its entirety.

BACKGROUND

1. Field of the Invention

The present disclosure relates to a package for a silicon photonics device and an implementation method thereof, and more particularly, to a package using a silicon photonics device in an optical communication system and an implementation method thereof.

2. Description of Related Art

The importance of optical transceivers and optical packages that transmit and receive an optical signal is more emphasized due to widespread use of Long-Term Evolution (LTE) service and personal mobile phones with 5G service, an expansion of a high-speed transmission network for various realistic multimedia services and an optical subscriber network, and the importance of high capacity data storage and backup devices.

Optical device packages evolve in a direction of the following steps. In a first step, "reliability" is considered first, and the package has a butter fly shape, in a second step, the package evolves in the form of "miniaturization" and has a transistor outline (TO)-can form, in a third step, the package evolves in the form of "multi-level composite" in which multiple functional elements are more densely packed and which is configured to have multiple layers, each of which has devices mounted thereon and is configured to be connected with a ball grid array (BGA) to form an input/output (I/O), in a step 4, the package evolves in a direction of "unification" for high density of multi-functional devices and is composed of a single layer and has a from in which devices are optimally mounted on the single layer and I/O for BGA or land grid array (LGA) connection is formed, and in a step 5, the package evolves in a direction of "integration" of multiple functional elements into a single platform and has a form of an interposer configuration in which optimal I/O wiring is built in on upper and lower portions of a single layer.

SUMMARY OF THE INVENTION

The present disclosure is directed to providing a package using a silicon photonics device in an optical communication system and an implementation method thereof.

It will be appreciated that the technical objects to be achieved by the present disclosure are not limited to the above-described technical objects, and other technical objects which are not described are to be clearly understood from the following description to those skilled in the art.

According to one embodiment of the present disclosure, a package for a silicon photonics device and an implementation method thereof are disclosed. According to an aspect of the present disclosure, there is provided a package for a silicon photonics device including a step difference control part having an upper surface, on which a silicon photonics device platform having a silicon photonics device mounted thereon is mounted, and configured to control a step difference generated between the silicon photonics device platform and one or more functional electronic devices mounted on an upper surface of a board, and a body part configured to transfer heat transferred through the step difference control part and heat transferred through a lower surface of the board to the outside by mounting the step difference control part on at least a partial region of an upper surface thereof and bringing the lower surface of the board into close contact with at least a part of the remaining region except for the partial region.

Here, the step difference control part may be inserted into an opening formed in the board and having a shape corresponding to the step difference control part.

Here, the package for a silicon photonics device may further include a support part mounted on the upper surface of the body part to be spaced a predetermined distance apart from the step difference control part and configured to support an optical coupling block that connects an optical interface (optical I/O) and the silicon photonics device platform.

Here, the step difference control part and the body part may be integrally formed. Here, a height of the step difference control part may be determined by a thickness of the board and a thickness of the silicon photonics device platform.

Here, each of the step difference control part and the body part may be formed of at least one of a metal material and an alloy material.

According to another aspect of the present disclosure, there is provided a package for a silicon photonics device including a step difference control part having an upper surface, on which a silicon photonics device platform having a silicon photonics device mounted thereon is mounted, and configured to control a step difference generated between the silicon photonics device platform and one or more functional electronic devices, a functional device mounting part on which the one or more functional electronic devices are mounted and which is formed in a shape surrounding the step difference control part, and a body part configured to transfer heat transferred through the step difference control part and heat transferred through a lower surface of the functional device mounting part to the outside by mounting the step difference control part on at least a partial region of an upper surface thereof and bringing the lower surface of the functional device mounting part into close contact with at least a part of the remaining region except for the partial region.

Here, the functional device mounting part may be inserted into an opening formed in a board and having a shape corresponding to the functional device mounting part.

Here, the body part may include a close contact region in close contact with a lower surface of the board, wherein the close contact region may be brought into close contact with the lower surface of the board when the board is mounted.

Here, the step difference control part, the functional device mounting part, and the body part may be integrally formed through a silicon-based semiconductor process.

Here, in the step difference control part, a concave portion may be formed in an upper direction by the functional device mounting part, and the silicon photonics device platform may be mounted in the concave portion.

Here, the functional device mounting part may be formed in a right side region, a left side region, and an upper side region of the step difference control part, and the right side region, the left side region, and the upper side region may be electrically separated from each other.

Here, in the functional device mounting part, an upper surface and the lower surface may be electrically connected to each other.

Here, the package for a silicon photonics device may be formed in a module type in which the silicon photonics device platform is mounted.

According to still another aspect of the present disclosure, there is provided an implementation method of a package for a silicon photonics device including a step difference control part configured to control a step difference generated between a silicon photonics device platform having a silicon photonics device mounted thereon and one or more functional electronic devices mounted on an upper surface of a board and a body part having an upper surface on which the step difference control part is mounted in at least a partial region, the method including mounting the board on the body part by bringing a lower surface of the board into close contact with at least a part of the remaining region except for the partial region, so that the step difference control part is inserted into an opening formed in the board and having a shape corresponding to the step difference control part, and mounting the silicon photonics device platform on an upper surface of the step difference control part.

The features briefly summarized above for this disclosure are only exemplary aspects of the detailed description of the disclosure which follow, and are not intended to limit the scope of the disclosure.

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
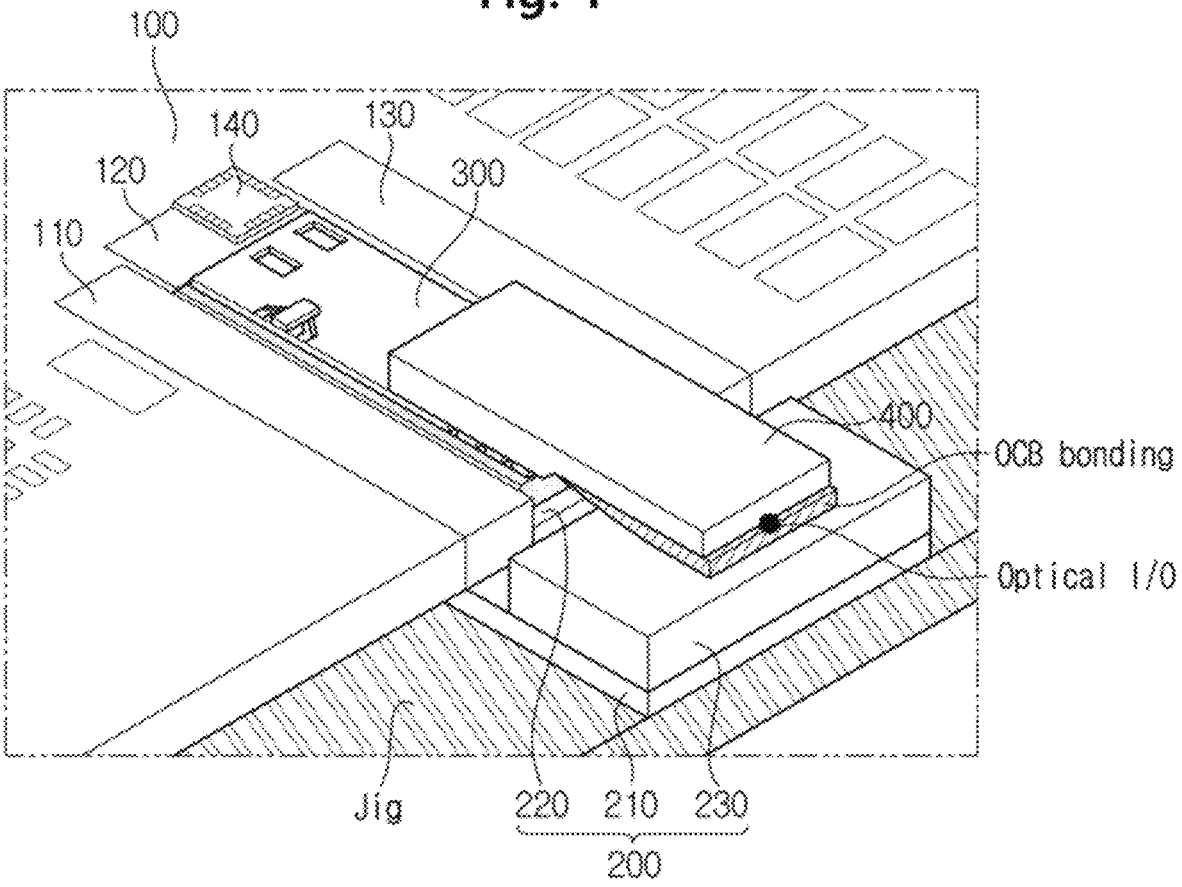
FIG. 1 is a view illustrating a three-dimensional (3D) stacked package structure using a silicon photonics device according to an embodiment of the present disclosure.

Hereinafter, embodiments of the present disclosure will be described in detail with reference to the accompanying drawings so that those skilled in the art may easily implement the present disclosure. However, the present disclosure may be implemented in various different forms, and is not limited to the embodiments described herein.

In describing the embodiments of the present disclosure, well-known configurations or functions will not be described in detail when it is determined that they may unnecessarily obscure the understanding of the present disclosure. In addition, parts irrelevant to the description of the present disclosure will be omitted in the drawings, and similar parts are denoted by similar reference numerals.

In the present disclosure, when a component is simply referred to as being "connected to," "coupled to," or "linked to" another component, this may mean that the component is "directly connected to," "directly coupled to," or "directly linked to" another component or is connected to, coupled to, or linked to another component with the other component intervening therebetween. In addition, when a component "includes" or "has" another component, this means that the component may further include still another component without excluding another component unless specifically stated otherwise.

In the present disclosure, the terms first, second, and the like are only used to distinguish one component from another component and do not limit the order or the degree of importance between the components unless specifically mentioned. Accordingly, a first component in one embodiment could be termed a second component in another embodiment, and, similarly, a second component in one embodiment could be termed a first component in another embodiment, without departing from the scope of the present disclosure.

In the present disclosure, components that are distinguished from each other are for clearly describing each feature, and do not necessarily mean that the components are separated. That is, a plurality of components may be integrated in one hardware or software unit, or one component may be distributed and formed in a plurality of hardware or software units. Thus, even when not mentioned otherwise, such integrated or distributed embodiments are included in the scope of the present disclosure.

In the present disclosure, components described in various embodiments do not necessarily mean essential components, and some of them may be optional components. Accordingly, an embodiment composed of a subset of components described in one embodiment is also included in the scope of the present disclosure. In addition, embodiments including other components in addition to the components described in the various embodiments are also included in the scope of the present disclosure.

In the present disclosure, representations of positional relationships used herein, such as an upper portion, a lower portion, a left side, a right side, and the like are described for convenience of description, and when the drawings shown in the present specification are viewed in reverse, the positional relationships described in this specification may be interpreted in reverse.

Embodiments of the present disclosure provide a package using a silicon photonics device in an optical communication system and an implementation method thereof. According to embodiments of the present disclosure, a step difference between a silicon photonics device (or photonics) chip and a high-speed signal processing device may be controlled, a generated heat transfer function of the silicon photonics device chip may be optimized, a three-dimensional (3D) space for the silicon photonics device chip may be internalized, and an optical system fixing and adhering capability may be enhanced, so that problems according to an evolution direction of the optical device package may be improved in a method of packaging a silicon optical device requiring high precision compared to a conventional III-V compound optical device.

FIG. 1 is a view illustrating a 3D stacked package structure using a silicon photonics device according to an embodiment of the present disclosure.

Referring to FIG. 1, the 3D stacked package structure using a silicon photonics device includes a board 100, a carrier 200, a silicon photonics device platform 300 on which the silicon photonics device is mounted, and an optical coupling block (OCB) 400. Here, the silicon photonics device may mean a single unit functional device, and the silicon photonics device platform may mean a complex configuration of several unit functional devices.

The board 100 is formed to have a groove having a shape corresponding to a shape of a region in which the silicon photonics device platform 300 is mounted, for example, a "C"-shaped opening, when mounted on the carrier 200, and includes a first pad part 110 formed on a left side region of the opening, a second pad part 120 formed on an upper side region of the opening, and a third pad part 130 formed on a right side region of the opening.

The second pad part 120 has a functional electronic device (PHY IC) 140 mounted thereon, serves to transfer bottom heat of the mounted functional electronic device 140, and performs a heat transfer function with the inside of the board.

The first pad part 110 and the third pad part 130 serves to transfer heat inside the board and block external heat, and serves as a hermetic sealing mold guide.

Each of the pad parts 110, 120, and 130 is electrically separated from each other so that heat generated from each of the pad parts 110, 120, and 130 is not mutually coupled.

Of course, the functional electronic device (PHY IC) 140 is not necessarily limited or defined to being mounted on the second pad part 120, but may be mounted on the first pad part 110 or the third pad part 130 depending on a situation.

In addition, the pad part is not limited or defined to being configured with the first to third pad parts, and may be configured with one pad part or four or more pad parts. This may be determined by an operator or an individual who provides the technology of the present disclosure, and may be determined according to an apparatus, a system, and an application to which the technology of the present disclosure is applied.

A predetermined space formed between the board 100 and the carrier 200 is a space for preventing epoxy from transitioning between both regions of the board 100 and the carrier 200, and may serve to maximize thermal curing.

Although not shown in the drawing, a corner portion between the first pad part 110 and the second pad part 120 and a corner portion between the second pad part 120 and the third pad part 130 may serve as side housings of the silicon photonics device platform 300. That is, the corner portions provide an effect of bringing the silicon photonics device platform 300 into close contact with the first pad part 110 to the third pad part 130 as much as possible. Through this, a 3D space for a silicon photonics chip may be embedded, and a high-density configuration effect may be provided.

In addition, since an upper surface and a lower surface of the board 100 are electrically connected through a through via, heat generated in each of the pad parts 110, 120, and 130 may be thermally distributed between the upper and lower surfaces of the board 100, so that a heat dissipation effect may be maximized. Through this, a generated heat transfer function of the silicon photonics chip may be optimized, and an optimal heat transfer effect may be provided.

On the upper surface of the board 100, the functional electronic device (PHY IC) 140 may be mounted and a configuration unit having functions of a high-speed electrical signal interface (electrical I/O_AC), a control and monitoring signal interface, and a power supply interface (electrical I/O_DC) may be mounted.

The carrier 200 includes a body part 210 corresponding to a body of the carrier and mounted on a carrier jig, a step difference control part 220 for controlling or adjusting a step difference, and a support part 230 for supporting the OCB. Hereinafter, the body part 210, the step difference control part 220, and the support part 230 will be named and described as a carrier_bottom, a carrier_inner, and a carrier_outer, respectively.

The carrier_bottom 210 is mounted on the carrier jig and has an upper surface on which the carrier_inner 220 and the carrier_outer 230 are mounted or formed in at least a partial region, and a peripheral region of the carrier_inner 220 is in close contact with the lower surface of the board 100, so that heat transferred through the carrier_inner 220 and heat transferred through the lower surface of the board 100, that is, heat transferred through the first pad part 110 to the third pad part 130 of the board 100 is transferred to the carrier jig.

In this case, the carrier_bottom 210 may serve to fix and support the 3D stacked package of the present disclosure, and serve to transfer the heat transferred through the pad parts 110, 120, and 130 formed in the board 100, on which one or more functional electronic devices are mounted, and the heat of the silicon photonics device platform 300 transferred through the carrier_inner 220 to the carrier jig. The carrier_bottom 210 is formed to have a constant thickness and may be formed of at least one of a metal material and an alloy material.

The carrier jig may serve to support the carrier 200 and disperse the heat transferred from the carrier_bottom 210 downward.

The carrier_inner 220 is formed in a convex shape in a predetermined region of an upper portion of the carrier_bottom 210, and may have a size and a shape corresponding to those of the silicon photonics device platform 300 mounted thereon. The silicon photonics device platform 300, on which the silicon photonics device is mounted is mounted on an upper surface of the carrier_inner 220, and the carrier_inner 220 controls a step difference generated between the silicon photonics device platform 300 and at least one functional electronic device 140 mounted on the upper surface of the board 100. For example, the carrier_inner 220 serves to control a step difference between the functional electronic device 140 mounted on the second pad part 120 and the silicon photonics device mounted on the silicon photonics device platform 300.

Here, the carrier_inner 220 may transfer heat generated from the silicon photonics device platform 300 to the carrier_bottom 210, and a thickness or height of the carrier_inner 220 may be determined by a thickness of the board 100 and a thickness of the silicon photonics device platform 300. The carrier_inner 220 may also be formed of at least one of a metal material and an alloy material.

The carrier_inner 220 comes into close contact with the opening formed in the board 100 when the board 100 is mounted on the carrier 200, so that the step difference between the silicon photonics device platform 300 and the functional electronic device 140 may be controlled or overcome.

The carrier_outer 230 is formed on the upper surface of the carrier_bottom 210 to be spaced a predetermined distance apart from the carrier_inner 220, and serves to support the OCB 400 that connects an optical interface optical I/O and the silicon photonics device platform 300. Here, the carrier_outer 230 may also be formed of at least one of a metal material and an alloy material.

Depending on a situation, the carrier_outer 230 may be formed by expanding the carrier_inner 220 to a region of the carrier_outer 230, so that the carrier_inner 220 may also perform the function of the carrier_outer 230. Of course, the carrier_inner 220 expanding to the region of the carrier_outer 230 may have the same thickness and height in all regions, or may have a greater thickness or height in the region of the carrier_outer 230.

The carrier_bottom 210, the carrier_inner 220, and the carrier_outer 230 forming the carrier 200 may be integrally formed or may be formed as separate components and combined.

Figure 2:
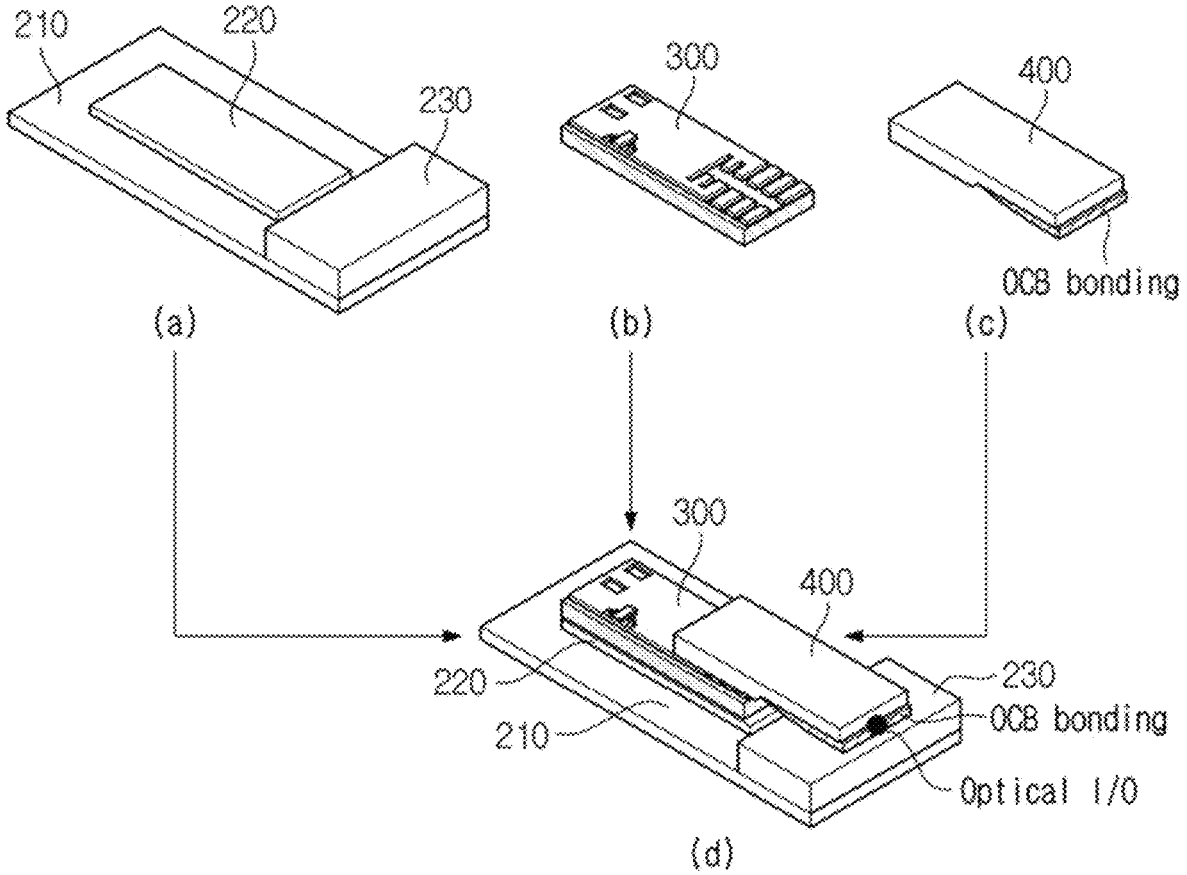
FIG. 2 is a view illustrating a coupling structure of a carrier, a silicon photonics device platform, and an optical coupling block in the 3D stacked package structure of FIG. 1.

FIG. 2 is a view illustrating a coupling structure of the carrier, the silicon photonics device platform, and the OCB in the 3D stacked package structure of FIG. 1, and as shown in FIG. 2, the carrier 200 composed of the carrier_bottom 210, the carrier_inner 220, and the carrier_outer 230 is mounted on the carrier jig, the silicon photonics device platform 300 is mounted on the carrier 200, that is, on the carrier_inner 220, and the OCB 400 is mounted on the silicon photonics device platform 300, thereby finally forming the 3D stacked package structure using a silicon photonics device. Thus, a step difference between the silicon photonics chip and a high-speed signal processing device may be controlled, so that a step difference between chips may be minimized, and an inter-chip step difference optimization effect may be provided. The inter-chip step difference optimization may mean minimizing an interface length between high-speed electrical signals and optimizing the quality of the high-speed signals.

Figure 3:
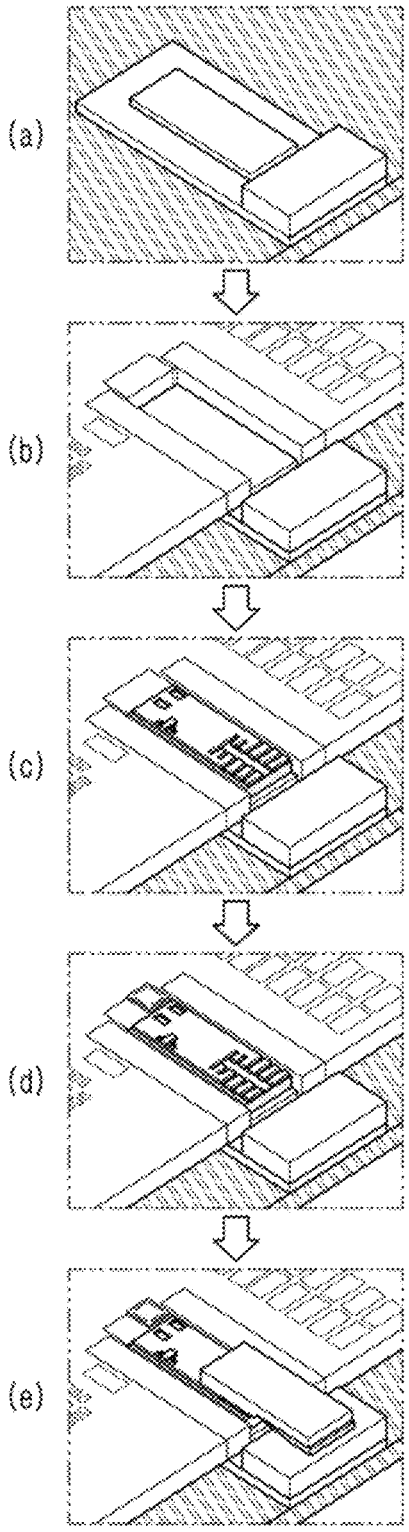
FIG. 3 is a view illustrating a process of implementing the 3D stacked package structure of FIG. 1.

FIG. 3 is a view illustrating a process of implementing the 3D stacked package structure of FIG. 1, and as shown in FIG. 3, a carrier is mounted or bonded on a carrier jig (see FIG. 3A), and then a board is mounted on the carrier so that a carrier_inner is coupled to an opening formed in the board (see FIG. 3B), so that a lower surface of the board comes into close contact with a carrier_bottom and pad parts of the board come into close contact with side surfaces of the carrier_inner. In addition, a silicon photonics device platform on which a silicon photonics device is mounted is mounted or bonded on the carrier_inner (see FIG. 3C), a functional electronic device is mounted on an upper portion of a second pad part (see FIG. 3D), and then, an OCB is aligned and mounted on the silicon photonics device platform (see FIG. 3E), thereby finally forming the 3D stacked package structure using a silicon photonics device. The mounting in the present disclosure may include all meanings of mounting, bonding, and wire bonding.

Figure 4:
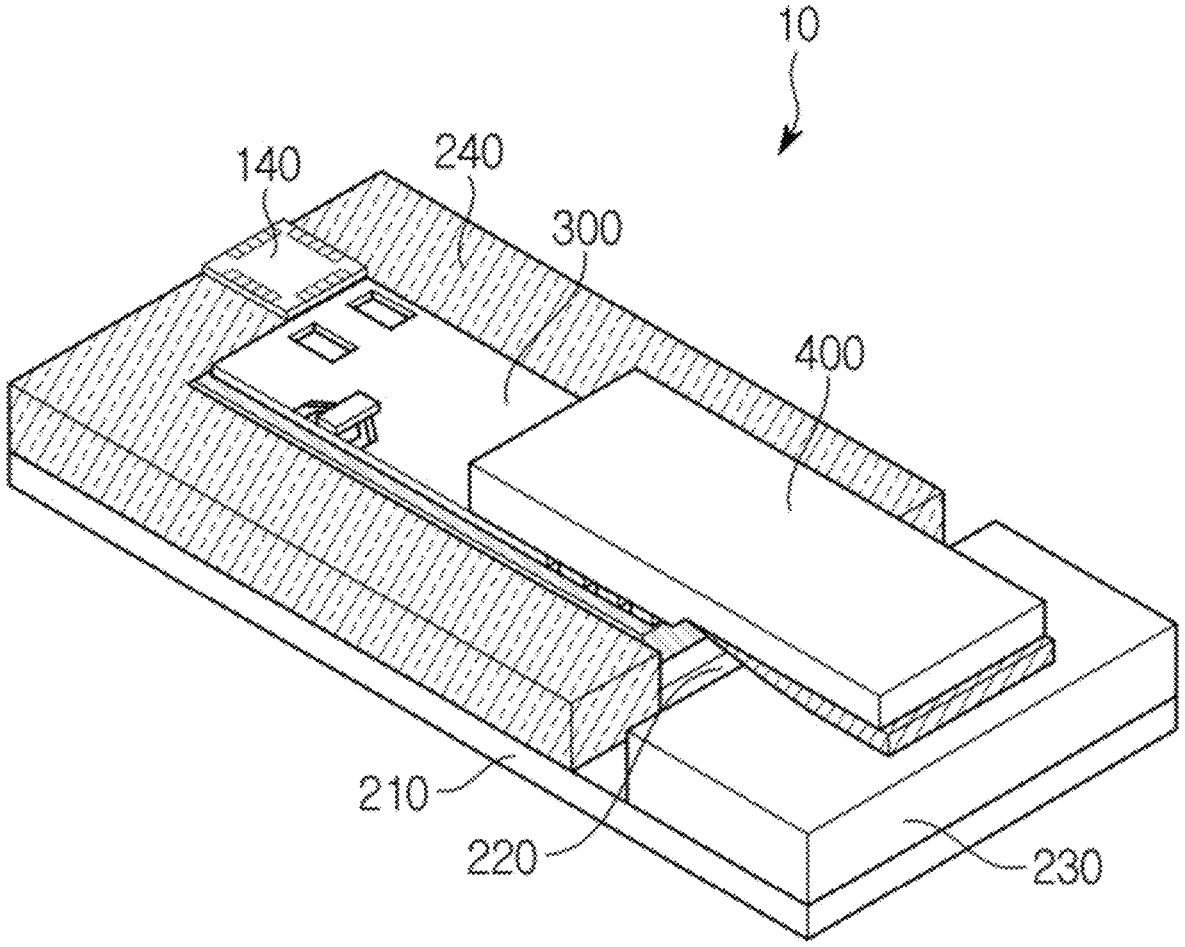
FIG. 4 is a view illustrating a 3D stacked package structure using a silicon photonics device according to another embodiment of the present disclosure.

FIG. 4 is a view illustrating a 3D stacked package structure using a silicon photonics device according to another embodiment of the present disclosure.

Referring to FIG. 4, a 3D stacked package structure 10 using a silicon photonics device according to another embodiment of the present disclosure is illustrated. Here, the remaining structure except a board is illustrated, and the structure in which the configuration of the pad parts 110, 120, and 130 of FIG. 1 is separated from the board is illustrated.

That is, the 3D stacked package structure 10 includes a carrier 200, a functional device mounting part 240, a silicon photonics device platform 300, and an OCB 400. Here, the carrier 200 including a carrier_bottom 210, a carrier_inner 220, and a carrier_outer 230, the silicon photonics device platform 300, and the OCB 400 have been described in detail with reference to FIG. 1, and thus descriptions thereof will be omitted.

The functional device mounting part 240 is a configuration unit corresponding to the first pad part 110 to the third pad part 130 formed on the board 100 of FIG. 1, has at least one functional electronic device 140 mounted thereon, and is formed in a shape surrounding the carrier_inner 220.

Here, the functional device mounting part 240 may be formed such that at least a portion of a side surface thereof is in close contact with a side surface of the carrier_inner 220 as a lower surface thereof is in close contact with the carrier_bottom 210. For example, the functional device mounting part 240 may be formed in a "C" shape so that an inner side surface thereof is in close contact with three side surfaces of the carrier_inner.

The functional device mounting part 240 may be formed as three different regions like the first pad part 110 to the third pad part 130 formed on the board 100 of FIG. 1, and the three different regions may be electrically separated. Further, the functional device mounting part 240 may also be formed as three or more electrically separated regions as well as the three electrically separated regions. Of course, the functional device mounting part 240 may be formed as one region.

Figure 5:
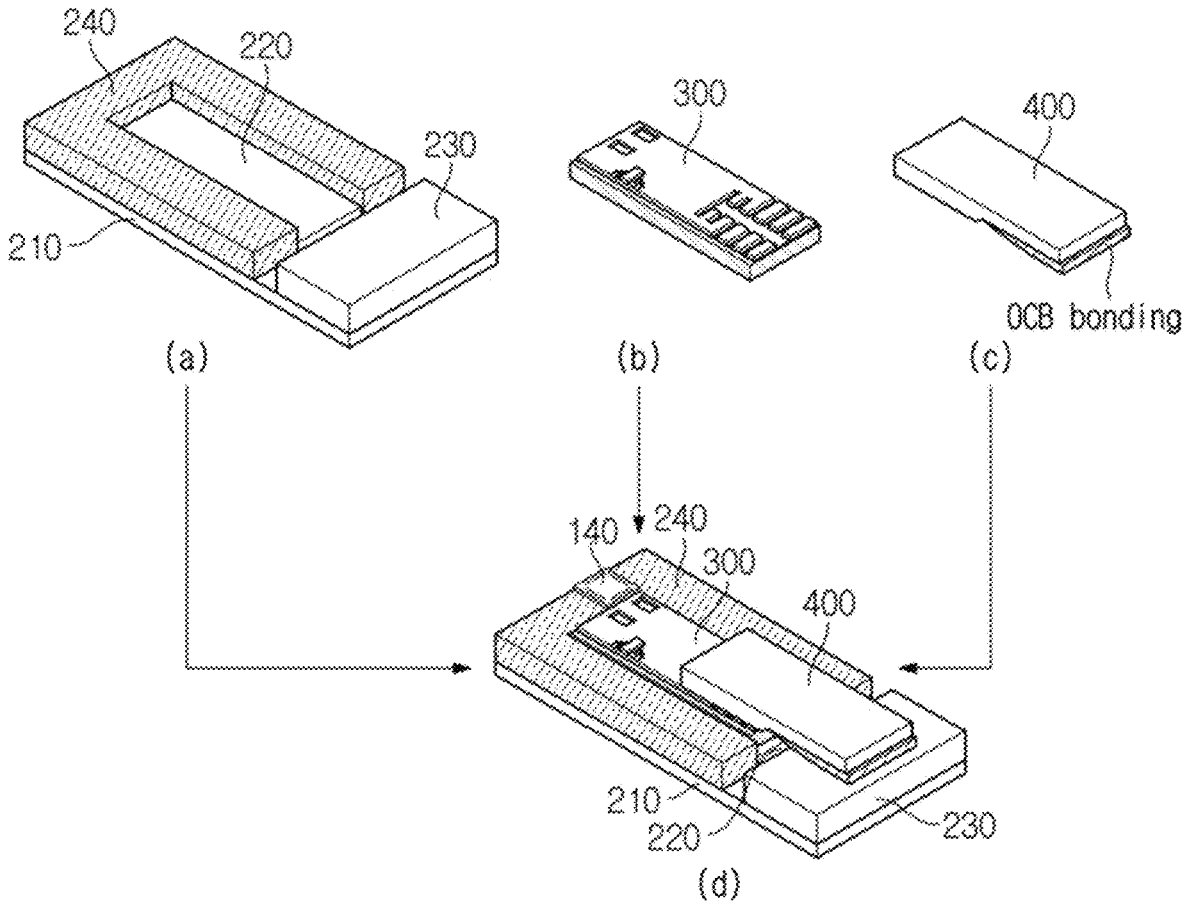
FIG. 5 is a view illustrating a coupling structure of a carrier, a functional device mounting part, a silicon photonics device platform, and an optical coupling block of FIG. 4.

FIG. 5 is a view illustrating a coupling structure of the carrier, the functional device mounting part, the silicon photonics device platform, and the OCB of FIG. 4, and as shown in FIG. 5, the carrier 200 composed of the carrier_bottom 210, the carrier_inner 220, and the carrier_outer 230 is mounted on a carrier jig, and then, the functional device mounting part 240 is mounted on the carrier 200 so as to come into close contact with at least a portion of an upper surface of the carrier_bottom 210 and the side surface of the carrier_inner 220. In addition, the silicon photonics device platform 300 is mounted on the carrier_inner 220 so as to come into close contact with the functional device mounting part 240, and the OCB 400 is mounted on the silicon photonics device platform 300, thereby finally forming the 3D stacked package structure using a silicon photonics device.

Figure 6:
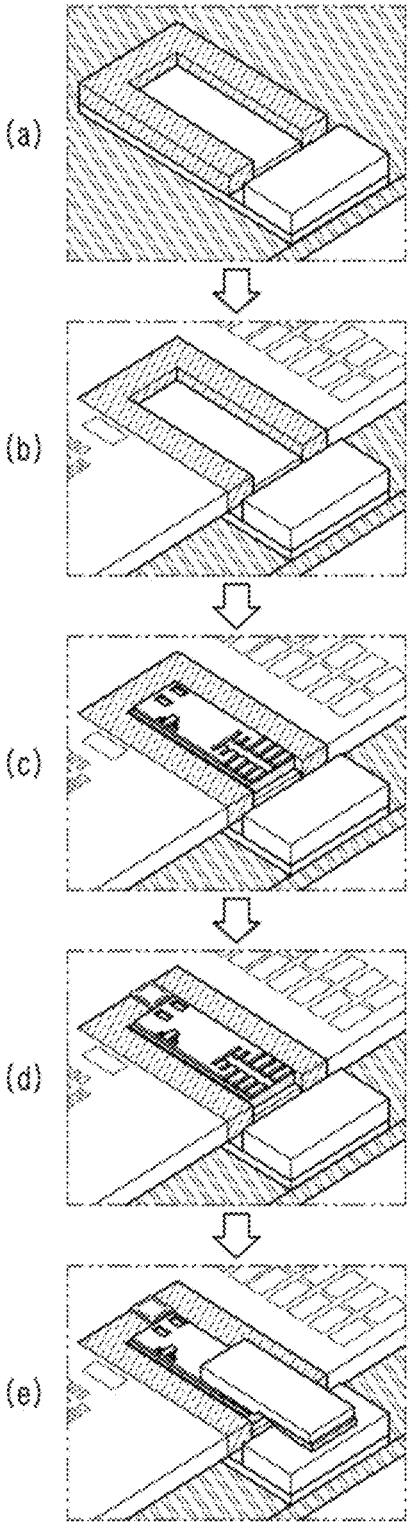
FIG. 6 is a view illustrating a process of coupling the 3D stacked package structure of FIG. 4 to a board.

FIG. 6 is a view illustrating a process of coupling the 3D stacked package structure of FIG. 4 to a board, and as shown in FIG. 6, a carrier is mounted or bonded on a carrier jig, and a functional device mounting part is mounted on the carrier (see FIG. 6A), and then, the board is coupled to the carrier on which the functional device mounting part is mounted (see FIG. 6B) such that an opening formed in the board, that is, a "C"-shaped opening corresponding to the functional device mounting part, comes into close contact with the functional device mounting part. In this case, the board and the functional device mounting part may be coupled through bonding. In addition, a silicon photonics device platform is mounted or bonded on a carrier_inner such that the silicon photonics device platform comes into close contact with the functional device mounting part (see FIG. 6C), a functional electronic device is mounted on the functional device mounting part (see FIG. 6D), and then an OCB is aligned and mounted on the silicon photonics device platform (see FIG. 6E), thereby finally forming the 3D stacked package structure using a silicon photonics device.

Figure 11:
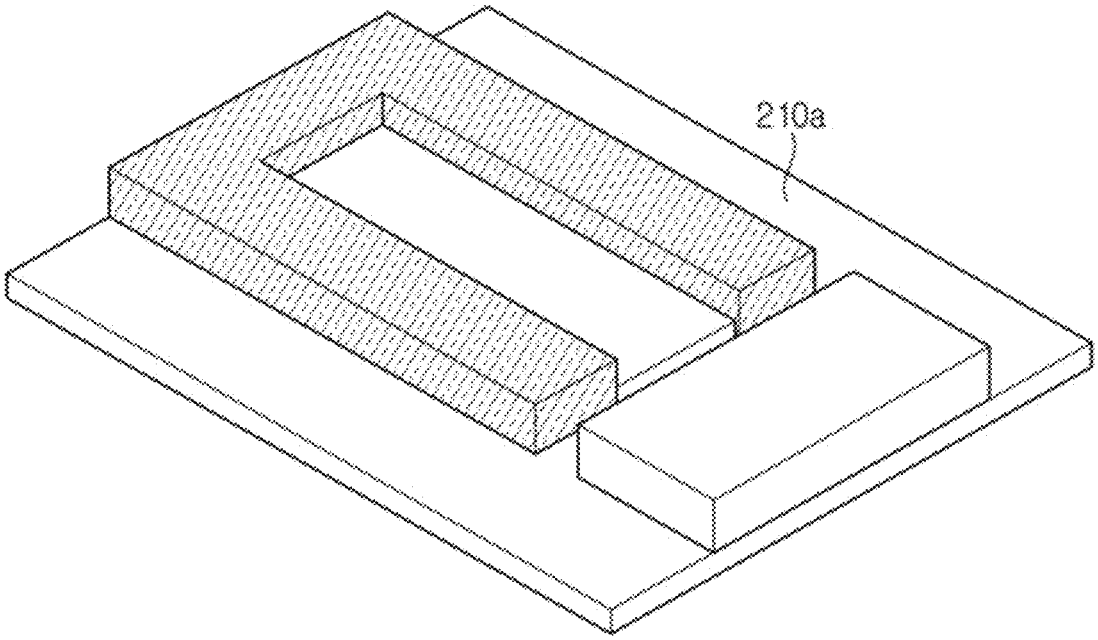
FIG. 11 is a view illustrating still another embodiment of the carrier structure.
Figure 11:
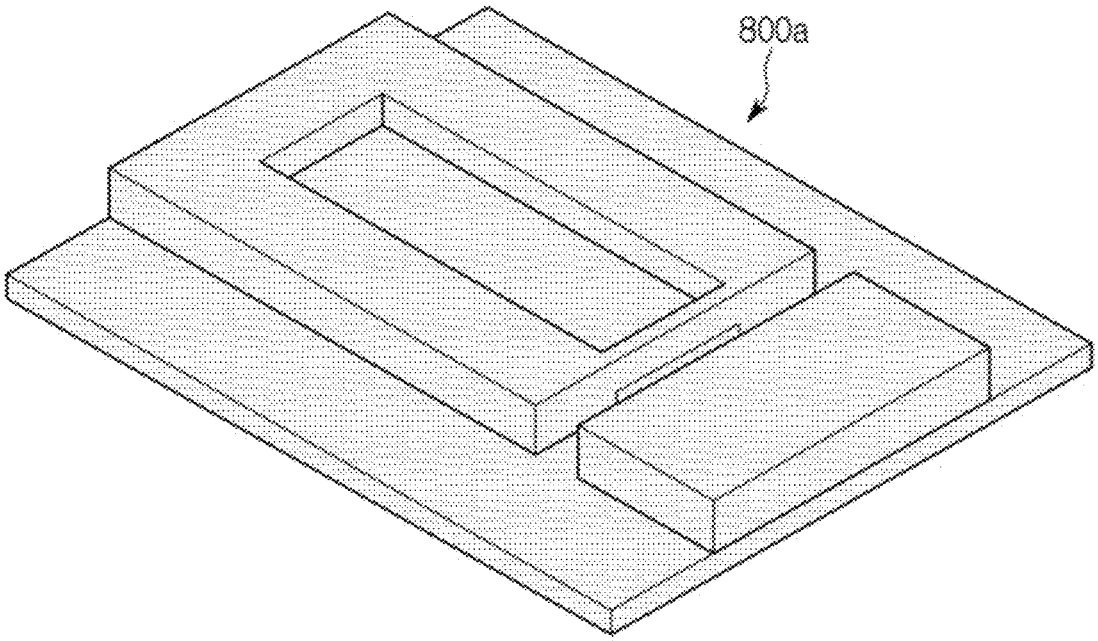

In the above-described operations, in order to easily couple the board to the carrier, on which the functional device mounting part is mounted, in the process of FIG. 6B, as shown in FIG. 11A, a carrier_bottom 210*a* may be formed to be wider than a width of the functional device mounting part 240, so that the functional device mounting part 240 may be mounted on the carrier_bottom 210*a* and then a lower surface of the board 100 may be mounted on an exposed upper region of the carrier_bottom 210*a*. Accordingly, when the board 100 is coupled to the carrier 200, the board 100 is simply mounted on the upper portion of the carrier_bottom 210*a* without needing to perform alignment with respect to the height or position.

Figure 7:
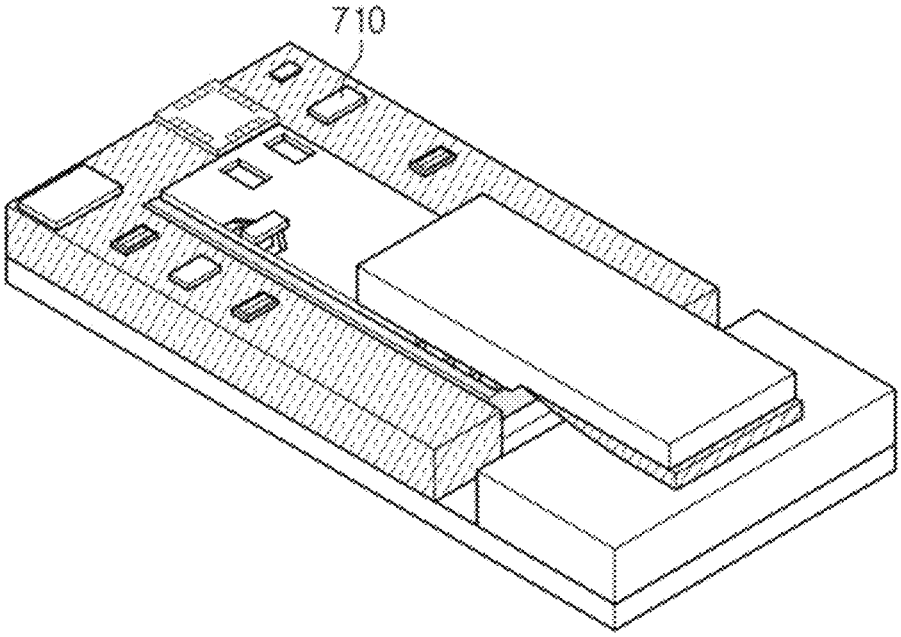
FIG. 7 is a view illustrating other embodiments of the 3D stacked package structure of FIG. 4.
Figure 7:
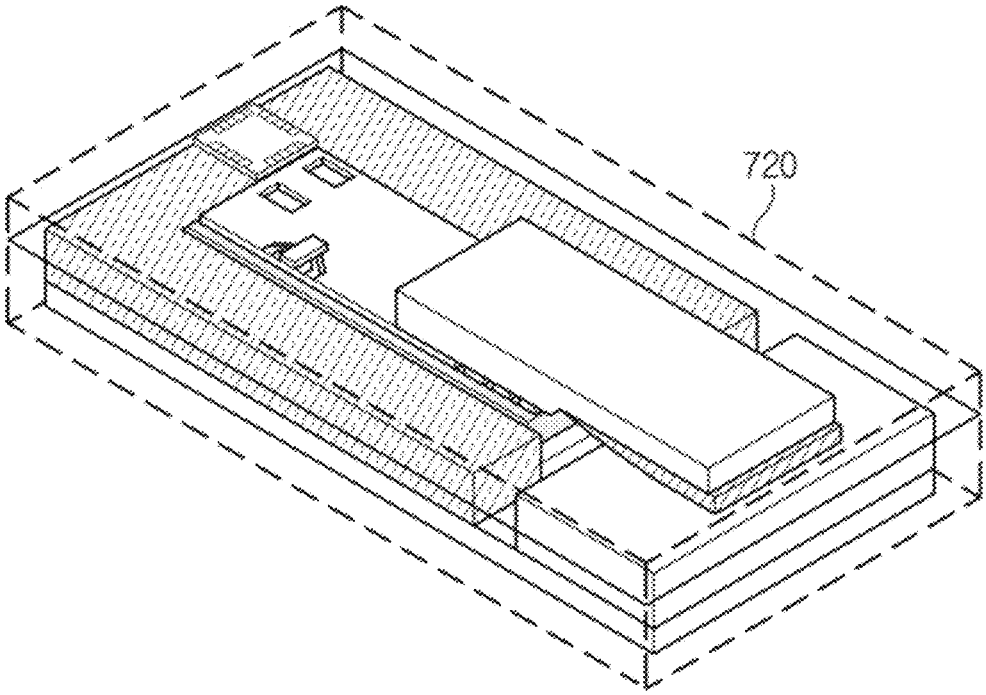

FIG. 7 is a view illustrating other embodiments of the 3D stacked package structure of FIG. 4, and as shown in FIG. 7A, the 3D stacked package structure may also have a structure in which one or more additional functional electronic devices 710 performing other functions are additionally mounted on the functional device mounting part 240 in addition to one functional electronic device, and functional electronic devices may be added and mounted in regions corresponding to the first pad part and the third pad part. In addition, as shown in FIG. 7B, the 3D stacked package structure of FIG. 4 and the 3D stacked package structure of FIG. 7A may be formed in a module type. For example, a 3D stacked package may be formed in a modular form by forming a cage 720 outside the 3D stacked package structure and allowing the cage 720 to protect the 3D stacked package using a silicon photonics device. In this case, the cage 720 may be formed of a material such as metal, plastic, ceramic, or the like.

Figure 8:
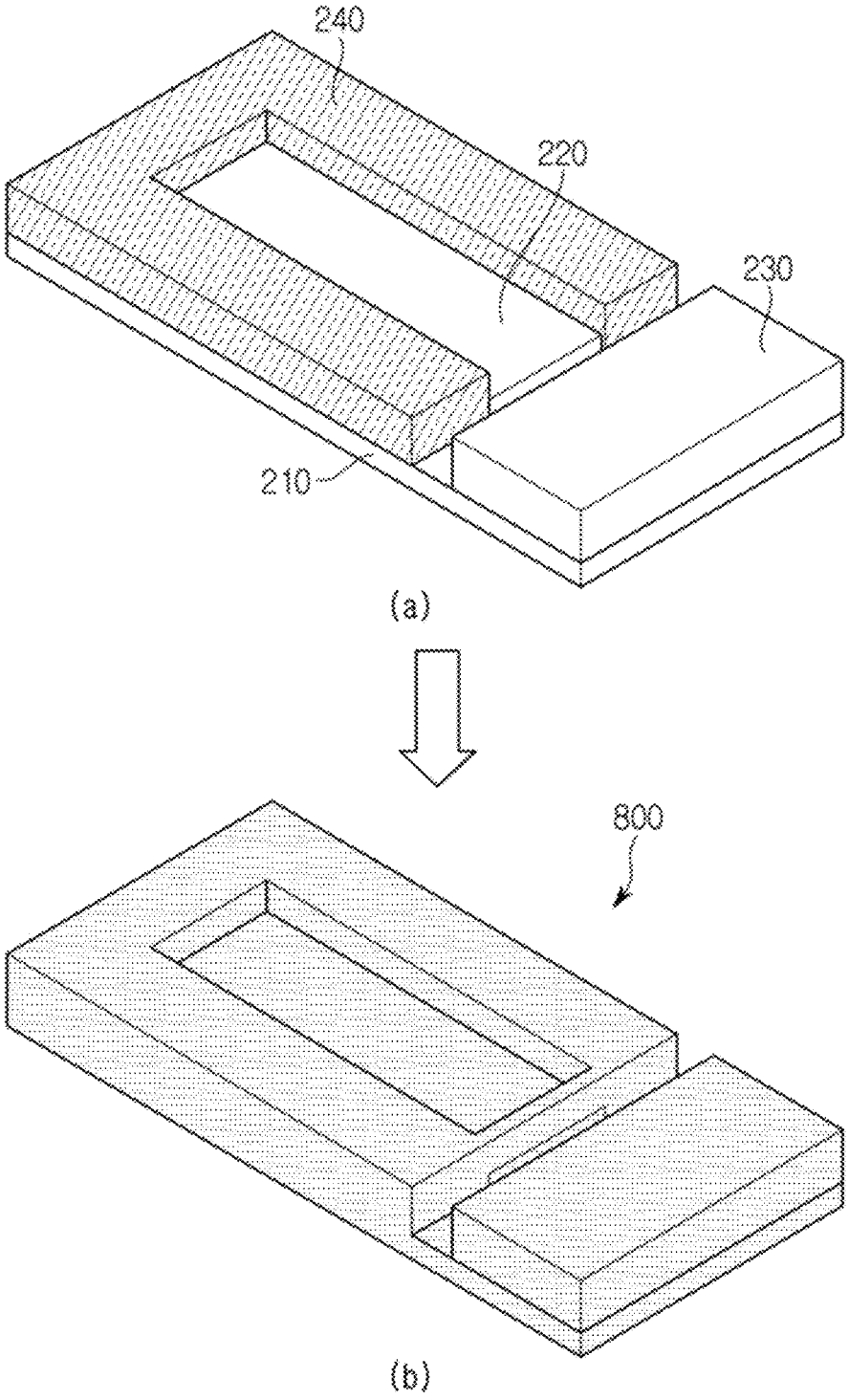
FIG. 8 is a view illustrating another embodiment of a carrier structure.

Although the carrier 200 and the functional device mounting part 240 described with reference to FIGS. 4 to 7 are separately formed, the carrier 200 and the functional device mounting part 240 may have an integrated structure of a 3D interposer. For example, as shown in FIG. 8, the carrier 200 including the carrier_bottom 210, the carrier_inner 220, and the carrier_outer 230, and the functional device mounting part 240 may be formed as a 3D interposer-type structure 800. Here, an interposer trench corresponding to a concave portion formed by the functional device mounting part 240 and the carrier_inner 220 of FIG. 8A may be formed in the 3D interposer-type structure 800 of FIG. 8B, and the silicon photonics device platform may be mounted in the interposer trench. The 3D interposer-type structure 800 may be integrally formed through a silicon-based semiconductor process, and since the 3D interposer-type structure 800 may be formed through the silicon-based semiconductor process, the silicon photonics device platform may be manufactured in a form of being mounted in the interposer trench through the semiconductor process.

Figure 9:
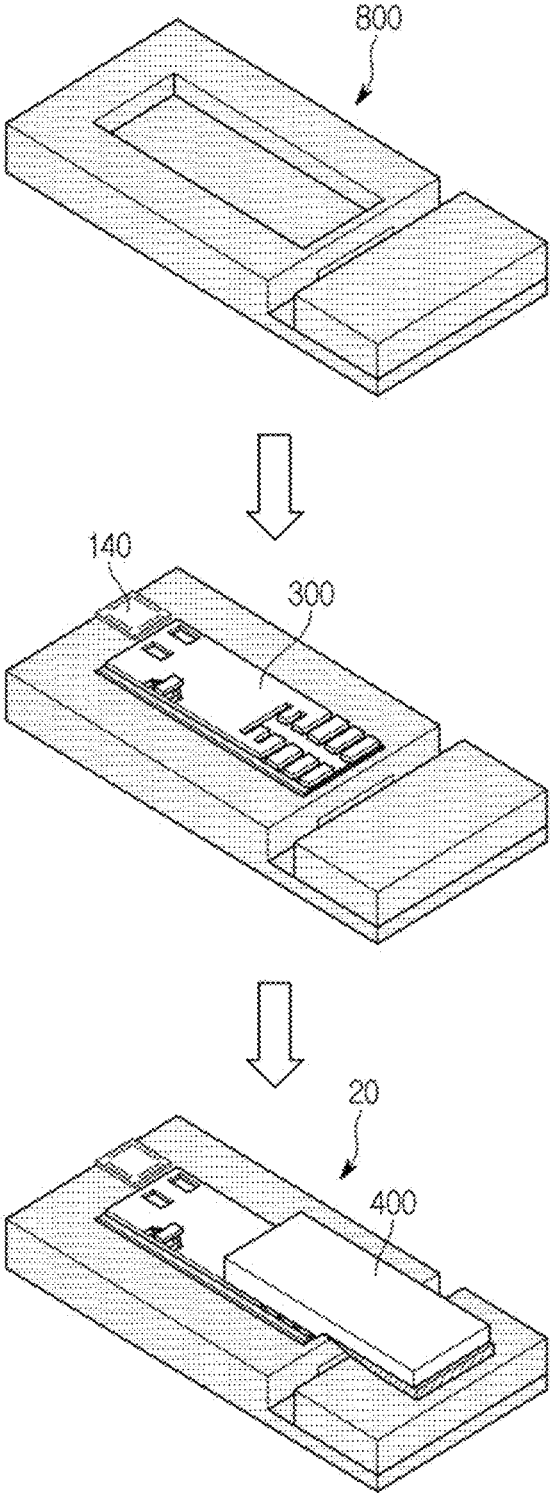
FIG. 9 is a view illustrating a 3D stacked package structure using a silicon photonics device according to still another embodiment of the present disclosure.

FIG. 9 is a view illustrating a 3D stacked package structure using a silicon photonics device according to still another embodiment of the present disclosure, and as shown in FIG. 9, a silicon photonics device platform 300 is mounted inside an interposer trench of a 3D interposer-type structure 800, a functional electronic device 140 is mounted on a region of the 3D interposer-type structure 800, which corresponds to a board pad, and then an OCB 400 is aligned and mounted on the silicon photonics device platform, thereby finally forming a 3D stacked package structure 20 using a silicon photonics device. As described above, when the 3D stacked package structure 20 is implemented using the 3D interposer-type structure 800, an assembly process may be simplified as compared with that in FIGS. 3 and 6.

Figure 10:
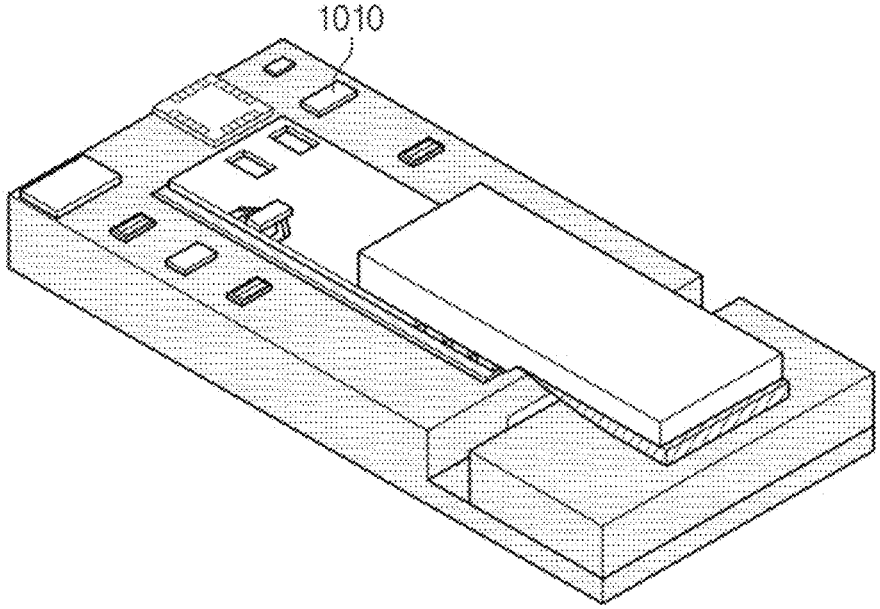
FIG. 10 is a view illustrating other embodiments of the 3D stacked package structure of FIG. 9.
Figure 10:
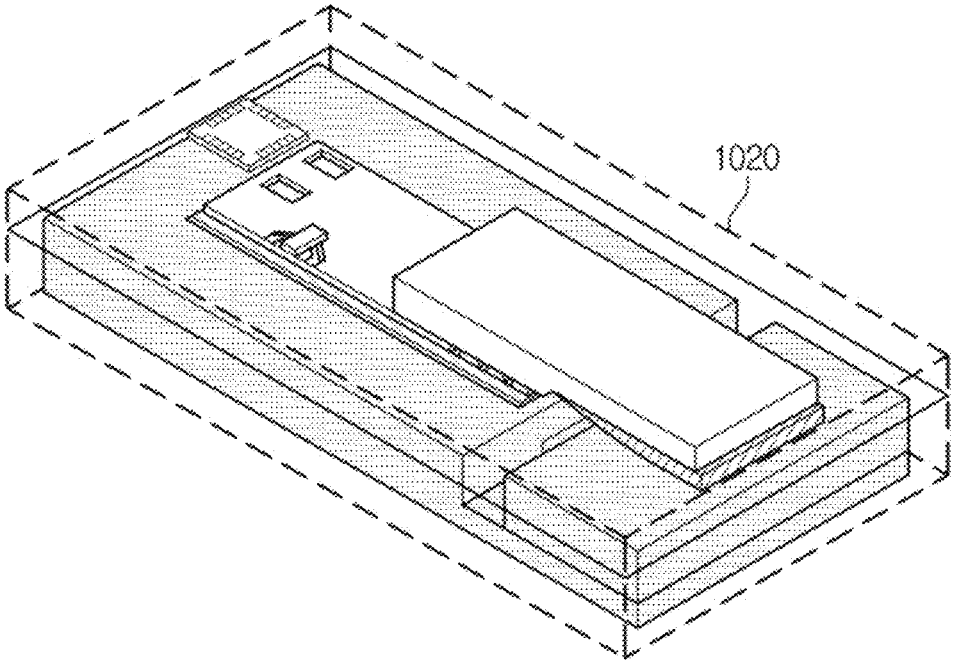

As shown in FIG. 10A, the 3D stacked package structure using the 3D interposer-type structure 800 may also have a structure in which an additional functional electronic device 1010 performing another function is additionally mounted on the 3D interposer-type structure 800 in addition to one functional electronic device, and functional electronic devices may be added and mounted in an interposer region of the 3D interposer-type structure 800, which corresponds to the first pad part and the third pad part. In addition, as shown in FIG. 10B, the 3D stacked package structure using the 3D interposer-type structure 800 may be formed in a module type. For example, a 3D stacked package may be formed in a modular form by forming a cage 1020 outside the 3D stacked package structure and allowing the cage 1020 to protect the 3D stacked package using a silicon photonics device. In this case, the cage 1020 may be formed of a material such as metal, plastic, ceramic, or the like.

In addition, when the structure of FIG. 9 is coupled to a board, in order to easily couple a 3D interposer-type structure to the board, as shown in FIG. 11B, a 3D interposer-type structure 800*a* may be formed such that a region corresponding to a carrier_bottom is wider than the board, so that the board may be easily mounted on the 3D interposer-type structure 800*a*.

As described above, the 3D package structure for a silicon photonics device according to embodiments of the present disclosure may control a step difference between a silicon photonics device (or photonics) chip and a high-speed signal processing device, optimize a generated heat transfer function of the silicon photonics device chip, include a 3D space for the silicon photonics device chip, and enhance an optical system fixing and adhering capability.

Furthermore, the 3D package structure for a silicon photonics device according to the embodiments of the present disclosure may be applied to various optical communication devices, systems, and applications. For example, the 3D package structure for a silicon photonics device according to the embodiments of the present disclosure may be applied to an optical transceiver, may also be applied to optical high definition multimedia interface (HDMI), may also be applied to an interface part between high performance central processing units (CPUs), and may also be applied to an optical interface inside a data center switch. That is, the embodiments of the present disclosure may be applied to all optical communication devices, systems, and applications using a silicon photonics device platform.

The above-described examples of the disclosure illustrate a case using a single-channel silicon photonics device, but this is merely an example, and multi-channel (two channels, four channels, eight channels, 16 channels, or the like) optical I/O as well as single-channel optical I/O may be implemented and utilized using a multi-channel silicon photonics device.

Figure 12:
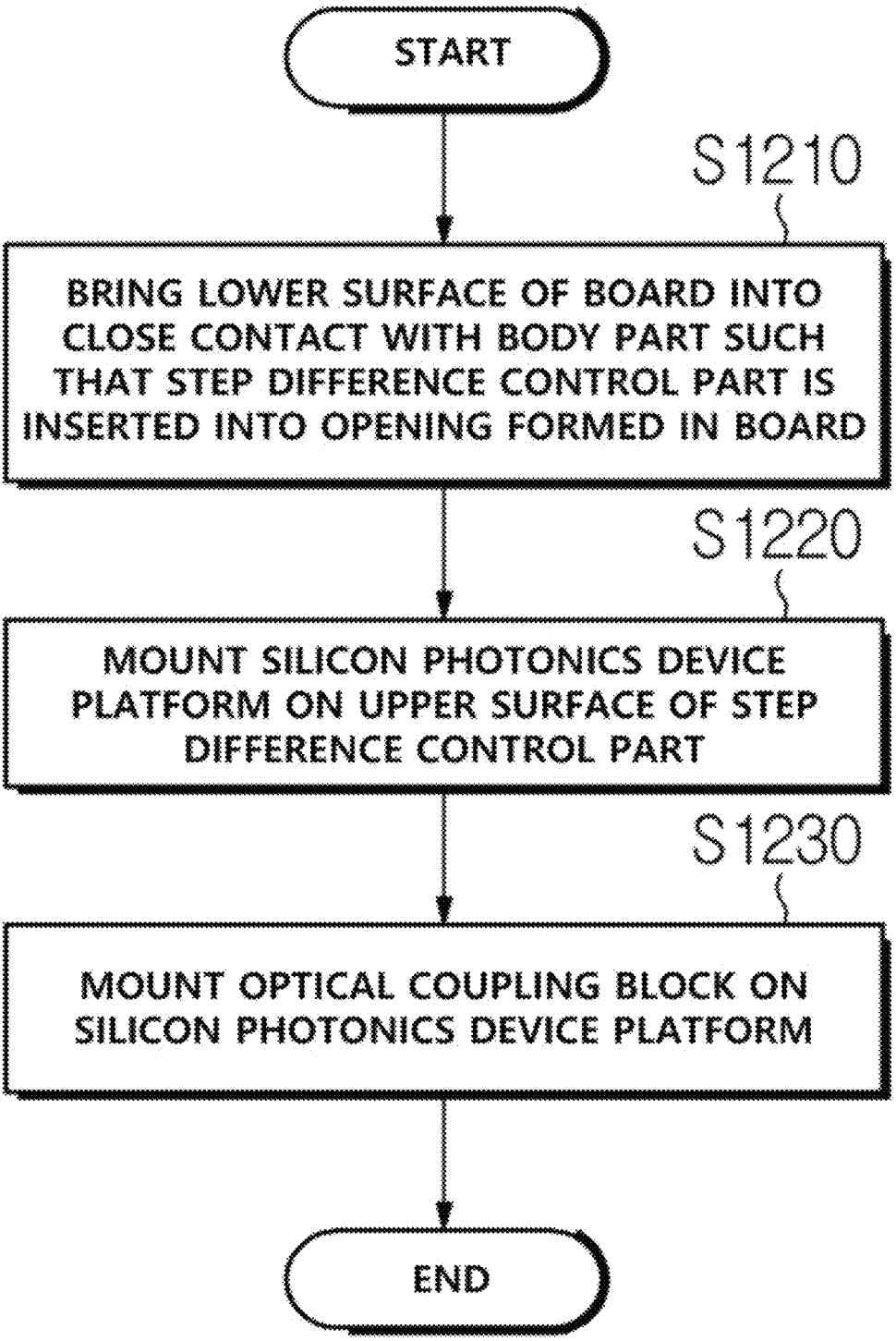
FIG. 12 is a flow chart illustrating an implementation method of a package for a silicon photonics device according to yet another embodiment of the present disclosure.

FIG. 12 is a flow chart illustrating an implementation method of a package for a silicon photonics device according to yet another embodiment of the present disclosure, and is a view illustrating the process of FIG. 3 as an implementation method.

Referring to FIG. 12, in the method for implementing the package for a silicon photonics device according to yet another embodiment of the present disclosure, a lower surface of a board is brought into close contact with a body part, that is, a carrier_bottom such that a step difference control part, that is, a carrier_inner is coupled to or inserted into an opening formed in the board, and thus the board is mounted on the carrier_bottom (S1210).

When the board is mounted on the carrier_bottom in operation S1210, a silicon photonics device platform is mounted on an upper surface of the carrier_inner (S1220).

In addition, a functional electronic device is mounted on an upper portion of the pad part of the board, and then, an OCB is aligned and mounted on the silicon photonics device platform, so that a 3D stacked package structure using a silicon photonics device is finally formed (S1230).

Of course, the method for implementing the package for a silicon photonics device may include not only the implementation method of FIG. 3, but also the implementation method of FIG. 6 and the implementation method of FIG. 9, and may also include all methods that may be implemented using the 3D package structure for a silicon photonics device according to the embodiments of the present disclosure.

Figure 13:
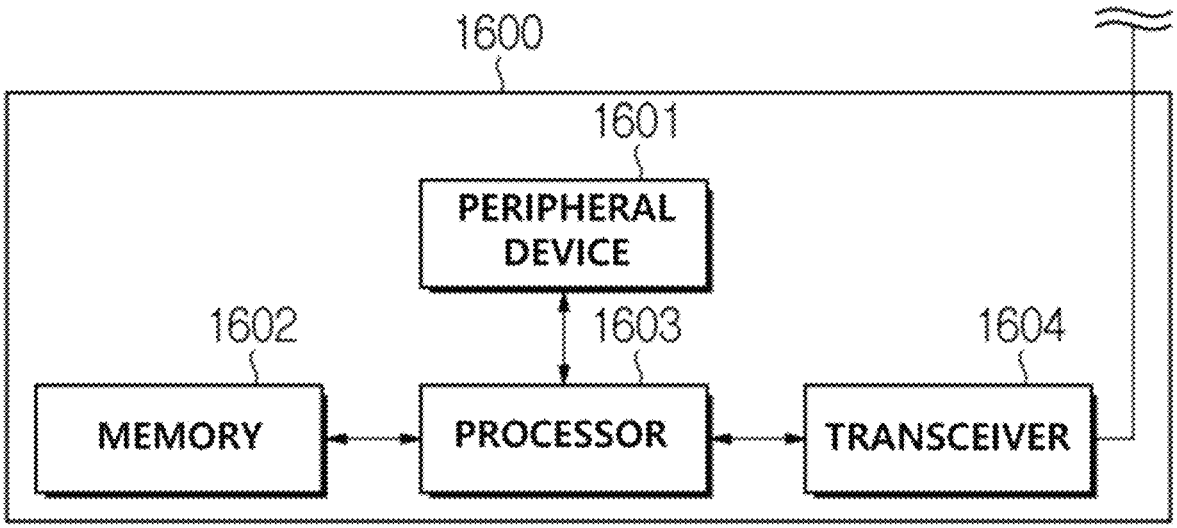
FIG. 13 is a block diagram of a device to which the silicon photonics device package structure according to the embodiment of the present disclosure is applied.

FIG. 13 is a block diagram of a device to which the silicon photonics device package structure according to the embodiment of the present disclosure is applied.

For example, the silicon photonics device package structure according to the embodiment of the present disclosure of FIG. 5 may be applied to a device 1600 of FIG. 13. Referring to FIG. 13, the device 1600 may include a memory 1602, a processor 1603, a transceiver 1604, and a peripheral device 1601. In addition, as an example, the device 1600 may further include another configuration, but is not limited to the above-described embodiment. In this case, the device 1600 may be, for example, a movable user terminal (e.g., a smart phone, a laptop computer, a wearable device, or the like). or a fixed management device (e.g., a server, a personal computer (PC), or the like).

More specifically, the device 1600 of FIG. 13 may be an illustrative hardware/software architecture such as an optical transceiver, a data center switch, a super computer equipped with an optical communication function, or the like. Herein, as an example, the memory 1602 may be a non-removable memory or a removable memory. In addition, as an example, the peripheral device 1601 may include a display, a global positioning system (GPS) device, or other peripherals, but is not limited to the above-described embodiment.

In addition, as an example, like the transceiver 1604, the above-described device 1600 may include a communication circuit, and based on this, the device 1600 may perform communication with an external device.

In addition, as an example, the processor 1603 may be at least one of a general-purpose processor, a digital signal processor (DSP), a DSP core, a controller, a micro controller, application specific integrated circuits (ASICs), field programmable gate array (FPGA) circuits, any other type of integrated circuit (IC), and one or more microprocessors related to a state machine. That is, the processor 1603 may be a hardware/software configuration performing a controlling role for controlling the above-described device 1600.

Here, the processor 1603 may execute computer-executable commands stored in the memory 1602 to perform various necessary functions of the device to which the silicon photonics device package structure is applied. For example, the processor 1603 may control at least one of signal coding, data processing, power controlling, input/output processing, and communication operations. In addition, the processor 1603 may control a physical layer, a medium access control (MAC) layer, and an application layer. In addition, as an example, the processor 1603 may execute an authentication and security procedure in an access layer and/or an application layer, but is not limited to the above-described embodiment.

As an example, the processor 1603 may perform communication with other devices via the transceiver 1604. As an example, the processor 1603 may execute computer-executable commands so that the device to which the silicon photonics device package structure is applied may be controlled to perform communication with other devices via a network. That is, communication performed in the present disclosure may be controlled. As an example, the transceiver 1604 may transmit a radio frequency (RF) signal through an antenna and may transmit a signal based on various communication networks.

In addition, as an example, MIMO technology, beam forming technology, or the like may be applied as antenna technology but is not limited to the above-described embodiments. In addition, a signal transmitted/received through the transceiver 1604 may be controlled by the processor 1603 by being modulated and demodulated, but is not limited to the above-described embodiment.

While the exemplary methods of the present disclosure described above are represented as a series of operations for clarity of description, it is not intended to limit the order in which the operations are performed, and the operations may be performed simultaneously or in different order as necessary. In order to implement the method according to the present disclosure, the described operations may further include other steps, may include remaining operations except for some of the operations, or may include other additional operations except for some of the operations.

The various embodiments of the present disclosure are not a list of all possible combinations and are intended to describe representative aspects of the present disclosure, and the matters described in the various embodiments may be applied independently or in combination of two or more.

In addition, various embodiments of the present disclosure may be implemented in hardware, firmware, software, or a combination thereof. In the case of implementing the present disclosure by hardware, the present disclosure may be implemented with application specific integrated circuits (ASICs), Digital signal processors (DSPs), digital signal processing devices (DSPDs), programmable logic devices (PLDs), field programmable gate arrays (FPGAs), general processors, controllers, microcontrollers, microprocessors, and the like.

The scope of the present disclosure includes software or machine-executable commands (e.g., an operating system, an application, firmware, a program, and the like) for enabling operations according to the methods of various embodiments to be executed on an apparatus or a computer, a non-transitory computer-readable medium having such software or commands stored thereon and executable on the apparatus or the computer.

According to the present disclosure, a package using a silicon photonics device in an optical communication system and an implementation method thereof can be provided.

Effects obtained in the present disclosure are not limited to the above-described effects, and other effects not described above may be clearly understood by those skilled in the art from the following description.

What is claimed is:

1. A package for a silicon photonics device, the package comprising:

a step difference control part having an upper surface, on which a silicon photonics device platform having a silicon photonics device mounted thereon is mounted, and configured to control a step difference generated between the silicon photonics device platform and one or more functional electronic devices mounted on an upper surface of a board; and a body part configured to transfer heat transferred through the step difference control part and heat transferred through a lower surface of the board to the outside by mounting the step difference control part on at least a partial region of an upper surface of the body part and bringing the lower surface of the board into close contact with at least a portion of a remaining region of the upper surface of the body part other than the partial region of the upper surface of the body part.

2. The package of claim 1, wherein the step difference control part is inserted into an opening formed in the board and having a shape corresponding to the step difference control part.

3. The package of claim 1, further comprising a support part mounted on the upper surface of the body part to be spaced a predetermined distance apart from the step difference control part and configured to support an optical coupling block that connects an optical interface (optical I/O) and the silicon photonics device platform.

4. The package of claim 1, wherein the step difference control part and the body part are integrally formed.

5. The package of claim 1, wherein a height of the step difference control part is determined by a thickness of the board and a thickness of the silicon photonics device platform.

6. The package of claim 1, wherein each of the step difference control part and the body part is formed of at least one of a metal material and an alloy material.

7. The package of claim 1, wherein the silicon photonics device platform has one or more multi-channel silicon photonics devices mounted thereon.

8. A package for a silicon photonics device, the package comprising:

a step difference control part having an upper surface, on which a silicon photonics device platform having a silicon photonics device mounted thereon is mounted, and configured to control a step difference generated between the silicon photonics device platform and one or more functional electronic devices;

a functional device mounting part on which the one or more functional electronic devices are mounted and which is formed in a shape surrounding the step difference control part; and a body part configured to transfer heat transferred through the step difference control part and heat transferred through a lower surface of the functional device mounting part to the outside by mounting the step difference control part on at least a partial region of an upper surface of the body part and bringing the lower surface of the functional device mounting part into close contact with at least a portion of a remaining region of the upper surface of the body part other than the partial region of the upper surface of the body part.

9. The package of claim 8, further comprising a support part mounted on the upper surface of the body part to be spaced a predetermined distance apart from the step difference control part and configured to support an optical coupling block that connects an optical interface (optical I/O) and the silicon photonics device platform.

10. The package of claim 8, wherein the step difference control part and the body part are integrally formed.

11. The package of claim 8, wherein:

the functional device mounting part is formed in a right side region, a left side region, and an upper side region of the step difference control part, and the right side region, the left side region, and the upper side region are electrically separated from each other.

12. The package of claim 8, wherein, in the functional device mounting part, an upper surface and the lower surface are electrically connected to each other.

13. The package of claim 8, which is formed in a module type in which the silicon photonics device platform is mounted.

14. The package of claim 8, wherein the functional device mounting part is inserted into an opening formed in a board and having a shape corresponding to the functional device mounting part.

15. The package of claim 14, wherein the body part includes a close contact region in close contact with a lower surface of the board, wherein the close contact region is brought into close contact with the lower surface of the board when the board is mounted.

16. The package of claim 8, wherein the step difference control part, the functional device mounting part, and the body part are integrally formed.

17. The package of claim 16, wherein the step difference control part, the functional device mounting part, and the body part are integrally formed through a silicon-based semiconductor process.

18. The package of claim 16, wherein:

in the step difference control part, a concave portion is formed in an upper direction by the functional device mounting part, and the silicon photonics device platform is mounted in the concave portion.

19. An implementation method of a package for a silicon photonics device including a step difference control part configured to control a step difference generated between a silicon photonics device platform having a silicon photonics device mounted thereon and one or more functional electronic devices mounted on an upper surface of a board and a body part having an upper surface on which the step difference control part is mounted on at least a partial region of the upper surface of the body part, the implementation method comprising:

mounting the board on the body part by bringing a lower surface of the board into close contact with at least a portion of a remaining region of the upper surface of the body part other than the partial region of the upper surface of the body part, so that the step difference control part is inserted into an opening formed in the board and having a shape corresponding to the step difference control part; and mounting the silicon photonics device platform on an upper surface of the step difference control part.

20. The implementation method of claim 19, further comprising mounting an optical coupling block, which connects an optical interface (optical I/O) and the silicon photonics device platform, on the silicon photonics device platform.

* * * * *